US012428736B2

(12) United States Patent
Miltenberger et al.

(10) Patent No.: US 12,428,736 B2
(45) Date of Patent: Sep. 30, 2025

(54) METHOD AND APPARATUS FOR CATHODIC PROTECTION OF STEEL IN A CONCRETE STRUCTURE LOCATED IN AN IONICALLY CONDUCTIVE LIQUID

(71) Applicant: Vector Corrosion Technologies Ltd., Winnipeg (CA)

(72) Inventors: Matthew Miltenberger, Kalamazoo, MI (US); Jason Chodachek, Melbourne, FL (US); John Ball, Frankfort, KY (US); David Whitmore, Winnipeg (CA)

(73) Assignee: Vector Corrosion Technologies Ltd., Winnipeg (CA)

( * ) Notice: Subject to any disclaimer, the term of this patent is extended or adjusted under 35 U.S.C. 154(b) by 582 days.

(21) Appl. No.: 17/946,654

(22) Filed: Sep. 16, 2022

(65) Prior Publication Data

US 2024/0093381 A1 Mar. 21, 2024

(51) Int. Cl.
*C23F 13/16* (2006.01)
*C23F 13/20* (2006.01)

(52) U.S. Cl.
CPC ..... *C23F 13/16* (2013.01); *C23F 13/20* (2013.01)

(58) Field of Classification Search
CPC ..... C04B 2111/26
See application file for complete search history.

(56) References Cited

U.S. PATENT DOCUMENTS

| | | | | |
|---|---|---|---|---|
| 5,714,045 | A * | 2/1998 | Lasa | C23F 13/16 204/196.18 |
| 9,382,631 | B1 * | 7/2016 | Villegas | C23F 13/14 |
| 9,447,506 | B2 | 9/2016 | Whitmore | |
| 10,227,699 | B2 | 3/2019 | Fujimori | |

FOREIGN PATENT DOCUMENTS

WO WO 2021/215928 10/2021

* cited by examiner

*Primary Examiner* — Alexander W Keeling
(74) *Attorney, Agent, or Firm* — Adrian D. Battison; Ade & Company Inc.; Ryan W. Dupuis

(57) ABSTRACT

Cathodic protection of steel in a concrete column in sea water is simplified by providing a pre-assembled unit including a jacket to surround the column carrying a bulk sacrificial anode outside the jacket and optionally an inner sacrificial anode of a zinc mesh or strips on an inside surface. The jacket can also include a pre-assembled junction box and couplings to connect to the steel. The jacket is attached to the surface of the column at the water line so that the bulk anode is located below the surface of the water and supported relative to the concrete surface solely by the connection of the bulk anode to the covering layer. The bulk anode can be formed of aluminum so as to be less toxic in sea water.

21 Claims, 3 Drawing Sheets

METHOD AND APPARATUS FOR CATHODIC PROTECTION OF STEEL IN A CONCRETE STRUCTURE LOCATED IN AN IONICALLY CONDUCTIVE LIQUID

This invention relates to a method of cathodic protection of the steel reinforcement in a concrete structure having a part of the structure in contact with a wetting medium and a part above the medium, such as a column or piling within a salt water environment.

BACKGROUND OF THE INVENTION

Concrete structures such as columns in salt water tend to corrode at the location above the salt water in the inter-tidal zone where the column is subject to wetting and drying and in the splash zone and above where the concrete is occasionally exposed to salt water.

One solution to this problem is to surround the column with a jacket surrounding the column and containing a layer of grout within which is buried or located a sacrificial anode such as a mesh, sheet or strips. This anode is electrically connected to the steel in the column to set up an electric current through the connection and an ionic current through the electrolyte and the concrete from the anode to the steel to tend to inhibit the corrosion of steel in favour of the corrosion of the sacrificial anode.

One example of an arrangement of this type is shown in U.S. Pat. No. 9,447,506 issued Sep. 20, 2016 and U.S. Pat. No. 7,520,974 issued Apr. 21, 2009 by the present Applicant. Further examples are shown in prior U.S. Pat. No. 5,714,045 (Lasa) assigned to Alltrista Corporation and issued Feb. 3, 1998 and in U.S. Pat. No. 4,692,066 (Clear) issued Sep. 8, 1987.

The disclosures of each of the above documents are incorporated herein by reference.

It is known to simply clamp an anode onto the column below water level to protect the portion of the column within the water. As the salt water is highly conductive, most of the current generated is transferred to steel in the wet portion of the column and little of the current generated in the galvanic action is transferred to the area of significant corrosion which is the area at and above the water line which is wetted and dried. This problem is discussed in the above patent of Clear.

In some cases, as shown for example in Lasa above, the above jacket and anode arrangement is used with a below water additional anode, commonly known as a bulk anode, so as to avoid the lower part of the mesh anode in the jacket which is mostly or wholly below water from being rapidly corroded and lost.

In other cases, for a simple inexpensive repair with no cathodic protection, a simple wrapping is applied around the column at the water line so as to cover up and hide the worst of the damage. This arrangement may provide a physical barrier but of course does not provide any cathodic protection by galvanic action so that the underlying corrosion continues. As discussed in Lasa above, this type of repair is considered to be merely cosmetic, merely acting to cover up the worst of the cracking and exposed steel. However this can provide a cheap fix with short life span of protection. The wrapping can surround a layer of grout which covers the worst of the cracking and repairs any holes or the wrapping can be applied directly to the column. In some cases, the wrapping is filled with a non-cementitious material such as epoxy.

SUMMARY OF THE INVENTION

It is an object of the present invention to provide an apparatus or method for cathodic protection for example of a column in sea water where the structure to be applied can be readily and easily applied to the column and provides effective protection of both the reinforcement below the water line and the reinforcement at or above the water line in the wetting zone.

According to the invention there is provided a method of cathodic protection of a steel reinforcement in a concrete structure located in an ionically conductive medium where a first part of the concrete structure is in contact with the medium below a surface of the medium and a second part of the concrete structure, continuous with the first part, is above the surface of the medium, the concrete structure having the steel reinforcement in both the first part and the second part, the method comprising:

- providing a covering layer arranged to cover at least part of at least one outer surface of the concrete structure so that an inside surface of the covering layer is located adjacent said at least one outer surface;
- providing a bulk anode of a sacrificial material for generating a galvanic current to the steel reinforcement in the concrete structure, the bulk anode being arranged so as to be positioned outside the covering layer and below the surface of the medium;
- the covering layer, prior to application to said at least part of at least one outer surface of the structure for covering thereof, carrying the bulk anode;
- attaching the covering layer to the concrete structure so as to attach the bulk anode carried thereby to the concrete structure;
- and providing electrical connections between the bulk anode and the steel reinforcement such that an ionic current flows between the bulk anode and the steel reinforcement tending to inhibit corrosion thereof.

Preferably the method includes providing an inner anode of a sacrificial material for generating a galvanic current to the steel reinforcement, the inner anode being arranged so as to be positioned between the inside surface of the covering material and said at least one outer surface of the concrete structure;

In one embodiment the covering layer, prior to application to said at least part of at least one outer surface of the structure for covering thereof, carries both the inner anode and the bulk anode and attaching the covering layer to the concrete structure so as to attach both the inner anode and the bulk anode carried thereby to the concrete structure. However the inner anode or anodes can be supplied separately in that they can be installed on the face of the column and wiring is connected without the jacket being in the way. The inner anodes can be individual strips or rods or can be formed as a mesh or sheet. In some cases the inner anode can be omitted and all protection is provided by the bulk anode.

Also according to the present invention there is provided an apparatus for cathodic protection of a steel reinforcement in a concrete structure located in an ionically conductive water medium so that a first part of the concrete structure is in contact with the medium below a surface of the medium and a second part of the concrete structure, continuous with the first part, is above the surface of the medium, the concrete structure having the steel reinforcement in both the first part and the second part, the apparatus comprising:

a covering layer arranged to cover at least part of at least one outer surface of the structure so that an inside surface of the covering layer is located adjacent the outer surface;

an inner anode of a sacrificial material for generating a galvanic current to the steel reinforcement, the inner anode being carried on the covering layer so as to be positioned, when the covering material is attached to the concrete structure, between the inside surface of the covering material and the outer surface of the concrete structure;

a bulk anode of a sacrificial material for generating a galvanic current to the steel reinforcement in the concrete structure, the bulk anode being carried on the covering layer so as to be positioned, when the covering material is attached to the concrete structure, outside the covering layer and below the surface of the medium;

an electrical connection from the inner anode for connection to the steel in the concrete;

an electrical connection from the bulk anode for connection to the steel in the concrete;

the covering layer, prior to application to said at least part of at least one outer surface of the structure for covering thereof, carrying both the inner anode and the bulk anode as a pre-assembled structure therewith.

The covering layer can be formed as a single component which wraps around the surfaces to be covered. Thus for example where the concrete structure forms a column, the covering layer can be formed into a jacket of a required cross-section as a single piece which can be opened along one side, wrapped around the column and connected to form a complete surrounding jacket. The covering layer can also comprise a plurality of separate panels where the method includes connecting the panels to form an assembly which engages at least two surfaces and typically all of the concrete structure or column. For example the layer can be formed in two halves which connect together along side edges. As another example, the layer can be formed of a series of panels. In particular in another example the separate panels include a plurality of flat panels and a plurality of corner panels for connecting together to engage a plurality of surfaces of the concrete structure.

In this arrangement formed of different panels, preferably at least one of the panels carries at least a part of the inner anode on an inner surface and at least one other panel carries the bulk anode on an outer surface. Alternatively at least one panel carries both at least a part of the inner anode on an inner surface and the bulk anode on an outer surface. In some cases, the inner anode is supplied as a separate component or components and hence is not part of the pre-assembled structure.

The arrangement herein is particularly applicable to arrangements where the concrete structure comprises a column or piling which can be of rectangular, square or circular cross-section in which the covering layer when attached forms a jacket fully surrounding the column.

Preferably the covering layer which is formed by the one or more covering components comprises a bulk anode as a pre-assembled structure and optionally the inner anode. This preassembled structure can be transported and supplied and simply applied to the concrete structure on site as supplied. Preferably also this pre-assembled structure also includes the electrical connection from the inner anode, if included, for connection to the steel reinforcement in the concrete structure and the electrical connection from the bulk anode for connection to the steel reinforcement in the concrete structure so that these can be pre-assembled and pre-attached and laid into place inside the covering layer or jacket.

Preferably the pre-assembled structure also includes an electrical junction box including connection terminals for connection to the electrical connection from the bulk anode and optionally from the inner anode and the electrical connection. This is preferably attached to the covering layer with the connecting wires in place and coupled to the junction box. In this way the structure can be readily attached to the concrete as supplied with the components already in place.

Preferably the electrical junction box is mounted inside the covering layer to be contained in the grout layer when introduced into the cover. However the box can also be accessible from outside the covering layer for example through a removable cover to access the terminals of the junction box for disconnection if required and for current or voltage testing by application of probes from a suitable meter.

As the bulk anode can be heavy requiring typically 10 to 50 pounds of zinc to provide the required extended period of protection for all of the steel material below the water line, the bulk anode can be mounted on an exterior of the covering layer with a connection plate on an interior surface of the covering layer to connect the anode with the plate by fasteners passing through the covering layer. This adds strength to the cover so that it can be formed from an extruded plastics material or from fiber reinforced plastics. The connection plate can be added to both the inside and outside for additional strength and stiffness. Preferably there is provided a support member extending from the bulk anode and/or the connection plate attached to the covering layer into the grout to better support the bulk anode when the grout hardens after casting.

Typically, the covering layer defines a form layer spaced from the surface of the concrete structure so as to define a cavity to be filled by receiving grout between the covering layer and the surface. The covering layer is thus typically impermeable to reduce the movement of water and the passage of oxygen to the steel in the area under the jacket.

In a particularly preferred arrangement, the covering layer includes a bottom closure member for preventing escape of the grout at the bottom which can then be filled from the top.

Preferably, as the covering layer supports the bulk anode mounted on the covering layer as a pre-assembled unit, when the covering layer is attached to the concrete structure, this acts to attach the bulk anode to the concrete at a height below the surface of the sea water. When attached therefore, the bulk anode is supported relative to the concrete surface solely by the connection of the bulk anode to the covering layer. This avoids the necessity for the bulk anode to be attached independently to the concrete. As the bulk anode is typically attached using a separate and custom mounting to the column below the water line, this often requires divers to make the connection which significantly increases difficulty and cost. The bulk anode is carried at the bottom of the jacket below the water line to provide protection for the steel below the water line though the high conductivity of the sea water.

The common structure including the covering layer may act as a form for a layer of grout to be cast onto the surface of the concrete or the common structure may be applied directly to the concrete surface.

Preferably the sacrificial anode comprises an anode sheet which may be a mesh material or other form of solid or perforated material for covering at least part of the concrete structure. Alternatively, the anode may be in the form of one or more separate components of suitable shape such as rods or strips and the covering layer may extend along the length or surround the anode rods or strips.

Preferably there is provided at least one activator at or adjacent the sacrificial anode to promote corrosion of the anode. The activator can be of any type well known in this field.

According to a further aspect of the invention there is provided a method of cathodic protection of a steel reinforcement in a concrete structure located in an ionically conductive medium so that a first part of the concrete structure is in contact with the medium below a surface of the medium and a second part of the concrete structure, continuous with the first part, is above the surface of the medium, the concrete structure having the steel reinforcement in both the first part and the second part, the method comprising:

providing a covering layer arranged to cover at least part of at least one outer surface of the concrete structure so that an inside surface of the covering layer is located adjacent said at least one outer surface;

providing an inner anode of a sacrificial material for generating a galvanic current to the steel reinforcement, the inner anode being arranged so as to be positioned between the inside surface of the covering material and said at least one outer surface of the concrete structure;

providing a bulk anode of a sacrificial material for generating a galvanic current to the steel reinforcement in the concrete structure, the bulk anode being arranged so as to be positioned outside the covering layer and below the surface of the medium;

attaching the covering layer to the concrete structure;

and providing electrical connections between the inner anode and the steel reinforcement and between the bulk anode and the steel reinforcement such that an ionic current flows between the inner and bulk anodes and the steel reinforcement tending to inhibit corrosion thereof;

wherein the bulk anode comprises aluminum.

The inner anode can comprise aluminum or zinc. The inner anode is contained so that any toxicity is also contained.

The main benefit of using aluminum bulk anodes is environmental. They are lighter than zinc and provide more current per mole but the main benefit is reduced toxicity to certain types of marine life. Zinc is a necessary element and is metabolized by mammals and fish. However, shellfish such as oysters however are very sensitive to zinc in the water and it can be toxic to oyster beds, mussels and other shellfish. For this reason, there is some hesitancy about using zinc anodes which are freely exposed in the water. Zinc anodes embedded in the jacket assembly are generally not a concern since the corrosion products are contained depending on the specific arrangement. Aluminum in the water is much less toxic to these creatures.

It will be appreciated that where this specification refers to aluminum or zinc, it is not intended that this is limited to the pure metal but of course the metal concerned can be provided as an alloy where the predominant metal is as defined so that the metal defined causes the predominant action in the cathodic protection.

BRIEF DESCRIPTION OF THE DRAWINGS

One embodiment of the invention will now be described in conjunction with the accompanying drawings in which.

DETAILED DESCRIPTION

Figure 1:
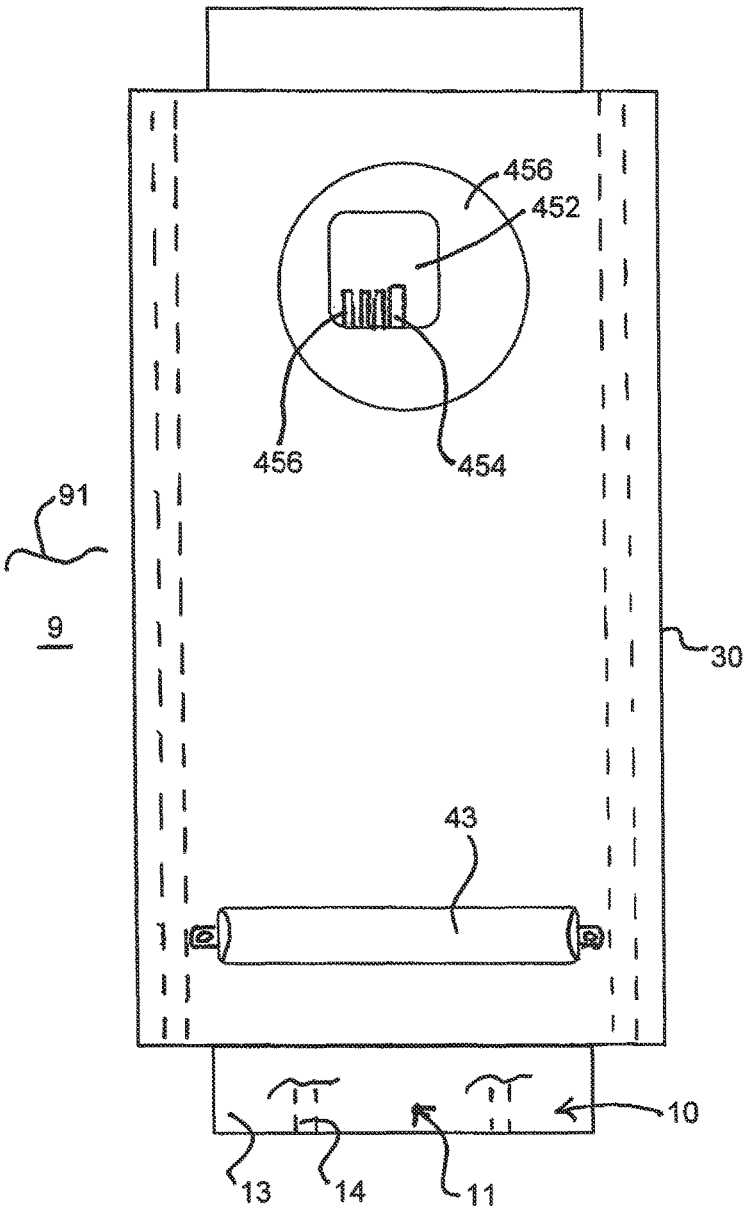
FIG. 1 is a front elevational view of a column including the application to the column of a first embodiment method of corrosion protection according to the present invention.
Figure 2:
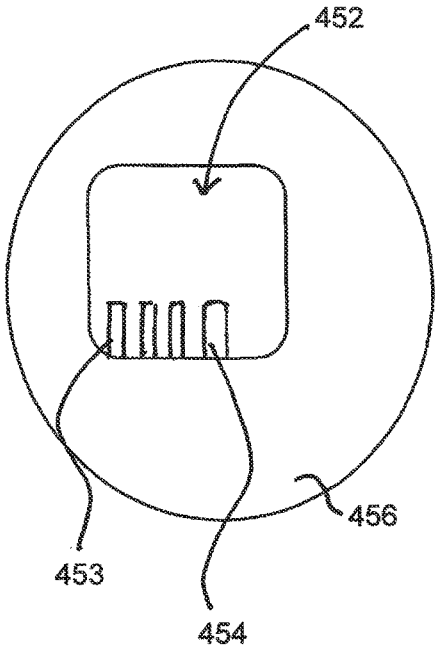
FIG. 2 is an enlarged view of the of the junction box of the embodiment of FIG. 1.
Figure 4:
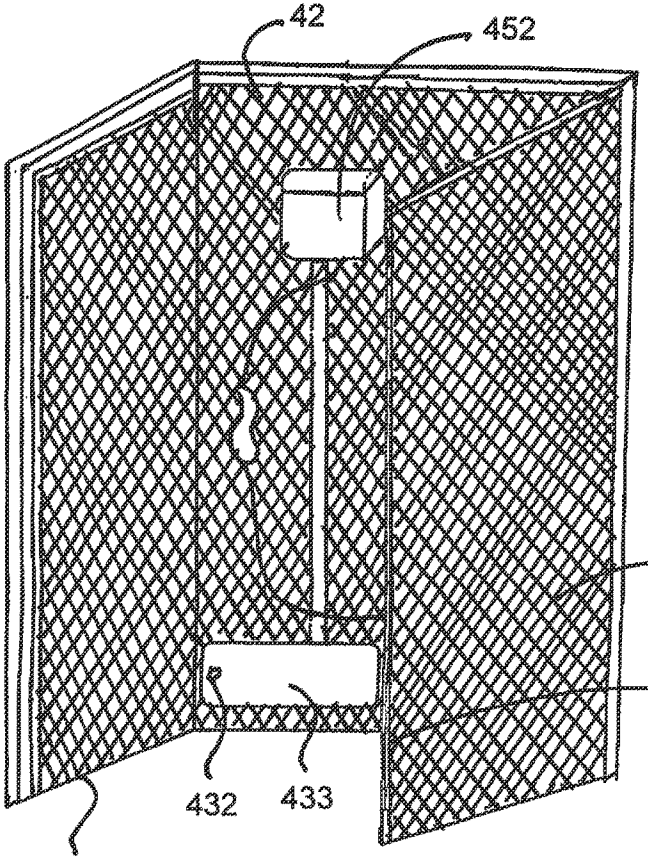
FIG. 4 is an isometric view of the jacket section of the embodiment of FIG. 1.
Figure 5:
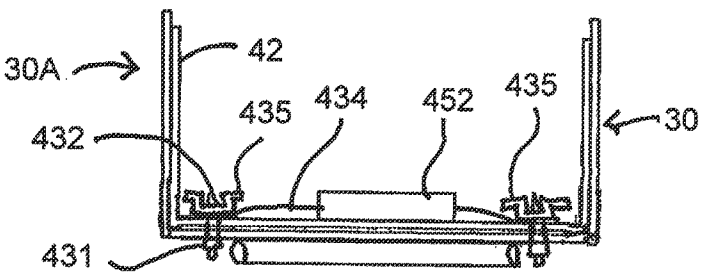
FIG. 5 is a top plan view of the jacket section of the embodiment of FIG. 1.
Figure 3:
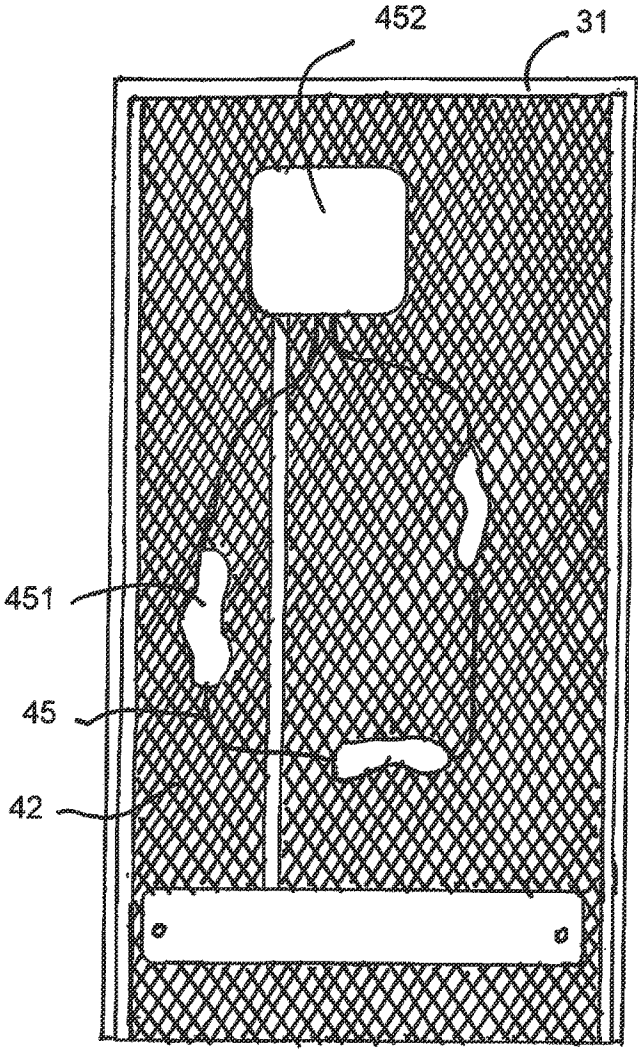
FIG. 3 is a rear elevational view of the jacket section of the embodiment of FIG. 1.

In FIG. 1 is shown a conventional reinforced concrete column mounted in water 9 so that the column 10 has a bottom end generally indicated at 11 mounted on a suitable support in the water with the upper end 12 arranged to carry a structure to be supported by the column. Typical columns of this type are formed of a concrete body 13 within which are steel reinforcing members generally indicated at 14. These include vertical longitudinal members 15 and transverse or peripheral hoops or ties 16. The steel reinforcement is located inside the column just under the outside surface 17 of the column.

The column is illustrated as being mounted so that a part of the length of the column is located in the inter-tidal zone generally indicated at 20 with a low tide mark indicated at 21 and a high tide mark indicated at 22. Above the high tide mark is a splash zone. It will of course be appreciated that the tides vary and the amount of splash height varies but in general the area between the low tide mark 21 and the top of the splash zone provides an area of the column which is subject to repeated wetting and drying depending upon the height of the water surrounding the column at any time.

This zone and the area extending upwards from this zone of the concrete column is particularly subject to corrosion since the steel is exposed to moisture, chlorides and oxygen which act to break down the steel and form corrosion products. These corrosion products may cause expansion sufficient to crack the concrete. In addition to this cracking, the corrosion of the steel may also result in loss of structural capacity.

The technique of the present invention is primarily intended as a repair technique for the column but it can also be used in new constructions.

The construction of the present method comprises a surrounding impermeable layer or jacket 30 which is attached to the column at a position outward of the outer surface 17 of the column. The jacket 30 may be formed of an impermeable material such as resin, plastics, fiber reinforced plastics or stainless steel. The jacket may be reinforced to provide structural strength to assist resisting movement of the concrete or the jacket may be fabric, or a stretchable or flexible material without such structural reinforcement so that it simply moves with any movement of the concrete. Where reinforced, it may be reinforced by fibres such as glass, plastics, carbon fibers or other materials well known to a person skilled in the art. In the embodiment as shown in FIGS. 1 to 5, the impermeable layer or jacket 30 is formed in pieces 30A and 30B which are connected at a joint 30C. In one embodiment the joint is a butting flange joint where two projecting flanges of the two parts of the jacket butt and are clamped together by bolts or screws with a layer of a sealing material between the two butting flanges. This ensures that the jacket is fully sealed around the column at the connections between the parts of the jacket to form a sealed sleeve around the column from a top edge 31 of the jacket to a bottom edge 32 of the jacket. Other methods of sealing the joints are also possible such as tongue and groove joints, lap splice joints and self-locking mechanical connectors.

Inside the jacket is filled with a cementitious or polymer grout or other filler material 33 to form a band of the material around the column within the jacket. In most cases the jacket is used as a form for applying the grout to the column. Prior to application, repairs can be made to any cracked portions by excavation or removal of damaged concrete materials so that the finished jacket is filled with material surrounding the column and filling any indentations, cracks or excavated portions of the concrete column. The grout is commonly Portland cement based which cures and bonds to the outside surface of the column and acts as an effective filler material. Other types of filler materials including other organic and inorganic based materials may be used.

During filling of the jacket, the bottom edge 32 of the jacket may be closed by a forming structure or platform 35 to hold the grout material in place until it is set. After the setting of the grout, the bottom form may be removed so that the bottom surface 34 of the grout is exposed. However it may also be left in place. At the top 31 of the jacket, after filling, an upper surface 35 of the grout is generally exposed.

The anode for the cathodic protection system comprises a sheet anode 42 surrounding the column under the jacket 30. The anode 42 is connected to the reinforcing steel by an electrical conductor or wire 45 which is connected to the steel reinforcement within the column as explained hereinafter. If necessary, additional connections can be provided to other parts of the reinforcing steel depending upon the electrical continuity of the steel reinforcement bars. The conductor wire 45 is brazed or soldered to the zinc mesh at locations 451 to provide an effective connection even after some corrosion has occurred. The conductor wire may be cast into the anode material directly The wire 45 is connected to a junction box 452. The junction box can also receive connecting wires from other anode sections, for example when the jacket is formed from separate components as explained hereinafter.

Thus the cathodic protection system includes the bulk anode 43 and optionally the inner anode 42 provided by the sacrificial anode material, the reinforcing steel 14, the electrical connection 45 from the anode to the steel and an ionic connection from the anode through ionically conductive material which may include the grout and the concrete to the steel to provide cathodic protection of the steel while effecting sacrificial corrosion of the anode.

The sacrificial anode may be provided as a sheet or layer extending fully around the column adjacent the outer surface of the concrete so that ionic current passes through the grout layer to the concrete. The sacrificial anode is preferably and typically formed as a zinc mesh of expanded metal or other perforated sheet. Alternatively, the sacrificial anode may be provided in the form of a solid sheet or as rods, strips or discrete pieces. A suitable known enhancement material may be provided at the anode as part of its structure or in a next adjacent layer such as the grout.

The sacrificial anode forms the sheet inside the jacket so that this also includes at least a part located above the water line or surface of the water indicated at 91 and part below the water line 91.

In order to provide an efficient manner of assembly of the construction for operation of the method above, the bulk anode and the jacket 30, together with the inner anode optionally, form an assembled structure for common application to the concrete structure. That is the two layers can be supplied together as a wrapping to engage around the column or otherwise to be applied to the surface of the concrete. This common assembly or pre-assembled structure can also include the junction box 452.

More preferably the covering layer 30, and the sacrificial anode or anodes all form an assembled structure for common application as an assembled structure on to the concrete structure with the covering layer covering the sacrificial anode. Thus the outer jacket 30 has the sacrificial anode formed as a layer inside the outer jacket. In this way this structure can be simply applied onto the column as a tight wrapping or as a form for grout to be poured into the jacket.

The impermeable sleeve 30 around the steel within the jacket prevents escape of moisture from the jacket during the time that the concrete is exposed to the air and thus is otherwise free to dry. The sleeve also prevents diffusion of oxygen to the steel.

As an alternative, the jacket can be formed as a single part which is wrapped around the column and a single overlap seal can be provided.

The jacket can be wrapped around the column and applied directly to the outside surface of the concrete. In this arrangement, therefore, there is provided no additional grout apart from possibly grout provided to fill cracks or holes within the concrete of the column. The intention is therefore that a simple sleeve is wrapped around the column in the inter-tidal and splash zone. If there is no necessity for repair, the jacket 130 is applied directly onto the column without any grout at all. In this arrangement the jacket can be provided by a fibreglass lay-up process formed on site simply by applying or wrapping fiber glass sheet material and a resin onto the outside surface of the column.

Other suitable plastic, rubber, organic or inorganic materials can be used as the sheet.

The bulk anode 43 of a sacrificial material such as zinc, or an alloy predominantly of zinc, generates a galvanic current to the steel reinforcement in the concrete structure, where the bulk anode 43 is positioned outside the covering layer or jacket 30 at or adjacent the bottom edge 32 so as to be located and below the surface 91 of the water 9.

The jacket may also carry at least a part of the inner anode 42 on the inner surface of the jacket and at least one panel of the jacket carries the bulk anode 43 on the outer surface.

Where the jacket is formed as separate panels connected together as shown in FIGS. 1 to 4, at least one panel carries both at least a part of the inner anode 42 on the inner surface, if provided as part of the assembly as shown, and the bulk anode on the outer surface. In the embodiment shown, both panels carry both the inner anode and a bulk anode so that the combined quantity of anode material of each of the inner anode and the bulk anode from both panels can be used to provide the required life of protection.

The bulk anode 43 mounted on the exterior of the jacket comprises a portion of metal which may have two end flanges 431 which are fastened by bolts 432 through the jacket and into a connection plate 433 on the interior so as to effectively support the heavy bulk anode on the exterior without tearing or distortion of the jacket.

The pre-assembled structure further comprises an electrical connection wire or conductor 434 from the bulk anode 43 for connection eventually to the steel reinforcement in the concrete structure. The wire 434 is connected to the plate 433 on the inside of the jacket and extends to the junction box 452.

The pre-assembled structure thus further comprises the electrical junction box 452 which has connection terminals 453 for connection to the electrical connection or connections 45 from the inner anode 42 and terminals 454 for connection to the electrical connection from the bulk anode.

The electrical junction box 452 is carried on the pre-assembled structure inside the covering layer and is accessible from outside the covering layer by removal of a covering plate 456. This allows the terminals to be disconnected if required and also provides access to the terminals for measuring current and/or voltage by suitable probes.

The arrangement herein can thus be used in a method of cathodic protection of a steel reinforcement in a concrete structure located in an ionically conductive medium where a first part of the concrete structure is in contact with the medium below a surface of the medium and a second part of the concrete structure, continuous with the first part, is above the surface of the medium, the concrete structure having the steel reinforcement in both the first part and the second part. The method includes providing the covering layer or jacket 30 arranged to cover at least part of at least one outer surface of the concrete structure so that an inside surface of the covering layer is located adjacent said at least one outer surface.

The method optionally further includes providing the inner anode 42 of a sacrificial material for generating a galvanic current to the steel reinforcement with the inner anode positioned between the inside surface of the covering material 30 and the outer surface 13 of the concrete structure 11.

The jacket, prior to its application to the structure carries the bulk anode and the optionally the inner anode as a pre-assembled structure and is then attached to the concrete structure so as to attach both the bulk anode and optionally the inner anode carried thereby to the concrete structure. The electrical connections between the inner anode and the steel reinforcement and between the bulk anode and the steel reinforcement are also provided simply and automatically by their connection to the junction box. In this way a single connection from the junction box to the steel can be provided. Alternatively if the steel is not sufficiently integrally connected, additional coupling wires can be taken from the junction box to selected locations on the steel.

Figure 6:
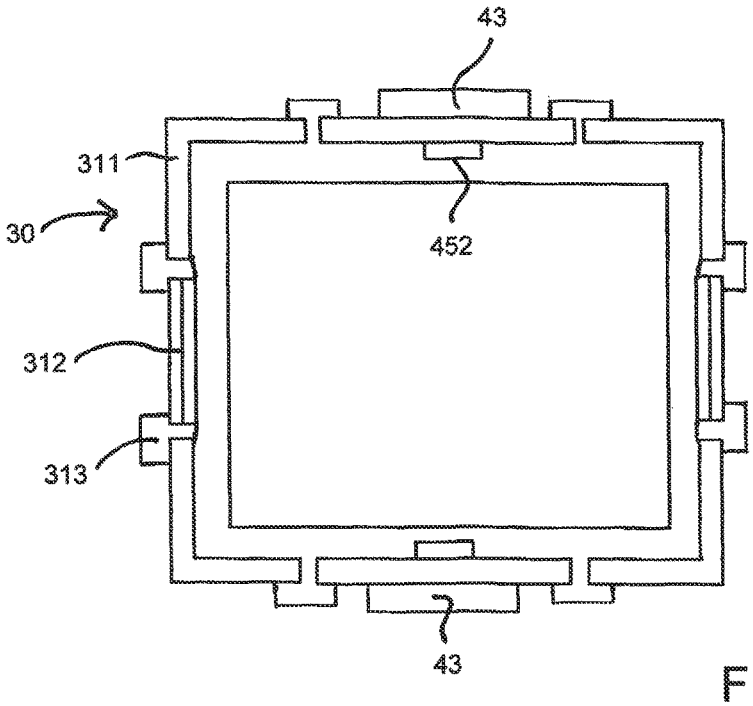
FIG. 6 is a transverse cross-sectional view through a column including the application to the column of a second embodiment of corrosion protection according to the present invention.
Figure 7:
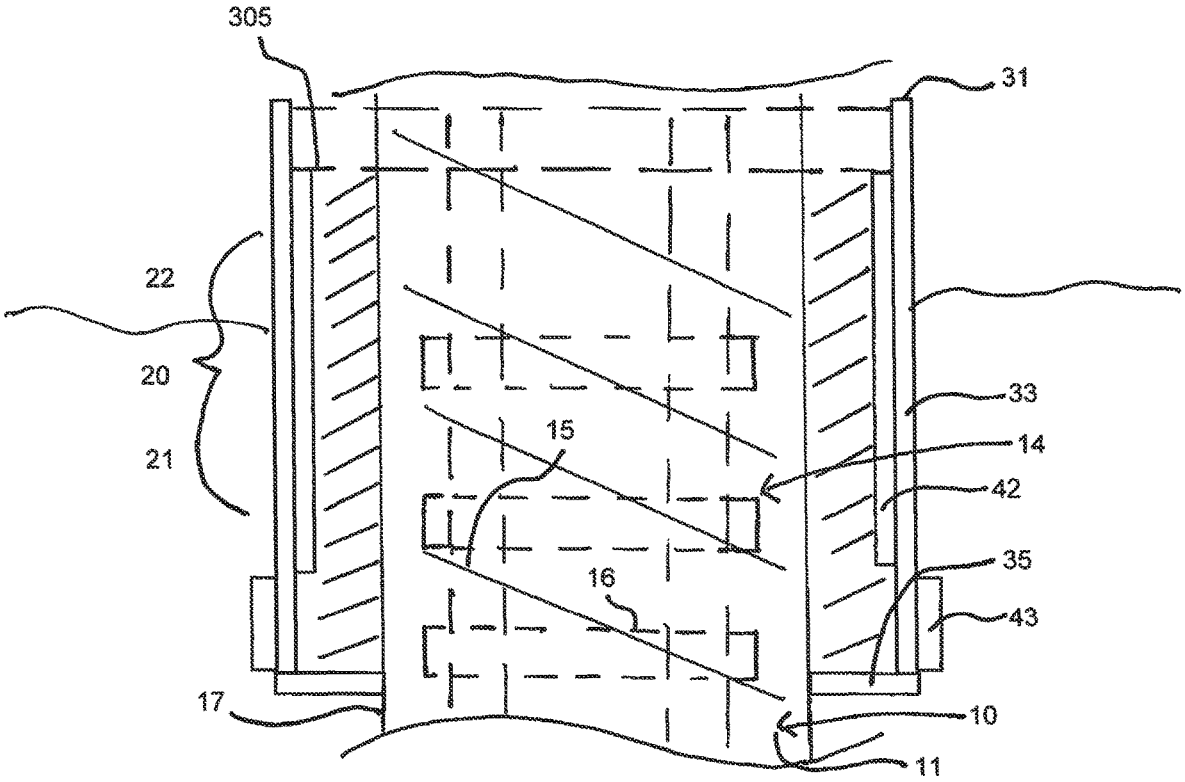
FIG. 7 is a longitudinal cross-sectional view through a column including the application to the column of a third embodiment of corrosion protection according to the present invention.

In FIG. 6 is shown very schematically an arrangement where the jacket is formed from a plurality of separate panels 311 and 312 and the method includes connecting the panels by suitable side connecting arrangements 313 to form an assembly which engages at least two surfaces of the concrete structure and typically wraps around the concrete in the form of the jacket.

The separate panels include a plurality of flat panels 312 and a plurality of corner panels 311 for connecting together to form the square or rectangular jacket. Separate flat panels can be provided, coupled together and flexed to surround a circular column.

At least one of the components or panels 312 carries at least a part of the bulk anode 43 and optionally at least one panel carries at least part of the inner anode 45 as a pre-assembled structure. The panels are then fastened together so that the competed jacket carries the bulk anode and optionally both the inner and bulk anodes.

As previously described, the covering layer or jacket may includes the bottom closure member 35 for preventing escape of the grout when poured into the forming mould defined by the jacket.

The lower part of the jacket carries and supports the bulk anode at or adjacent the lower end 32, when the covering layer is attached, at a height below the surface of the water. In this way, the bulk anode is supported relative to the concrete surface solely by the connection of the bulk anode to the covering layer without any necessity for the bulk anode to be separately attached to the column below the water.

Additionally a reinforcing member 435 may be attached directly or indirectly to the bulk anode or its connection plate to provide additional reinforcing and support to the bulk anode into the grout when the grout is poured and sets. The reinforcement thus extends from the inside surface of the covering layer toward the surface of the concrete to be buried when the grout is poured.

The inner anode can be pre-attached or more preferably for strip and rod anodes and for modular jackets the inner anodes are supplied separately. They can be thus installed on the face of the column and wiring is connected without the jacket being in the way whereupon the jacket is applied later onto the inner anode and the column.

The bulk anode 43 is preferably formed from Aluminum, or an alloy predominantly of aluminum, as discussed above but can also be of zinc, or an alloy predominantly of zinc, when the potential toxicity is not relevant.

The invention claimed is:

1. A method of cathodic protection of a steel reinforcement in a concrete structure located in an ionically conductive medium where a first part of the concrete structure is in contact with the medium below a surface of the medium and a second part of the concrete structure, continuous with the first part, is above the surface of the medium, the concrete structure having the steel reinforcement in both the first part and the second part, the method comprising:

providing a covering layer arranged to cover at least part of at least one outer surface of the concrete structure so that an inside surface of the covering layer is located adjacent said at least one outer surface;

providing a bulk anode of a sacrificial material for generating a galvanic current to the steel reinforcement in the concrete structure, the bulk anode being arranged so as to be positioned outside the covering layer and below the surface of the medium;

the covering layer, prior to application to said at least part of at least one outer surface of the structure for covering thereof, carrying the bulk anode;

attaching the covering layer to the concrete structure so as to attach the bulk anode carried thereby to the concrete structure;

and providing electrical connections between the bulk anode and the steel reinforcement such that an ionic current flows between the bulk anode and the steel reinforcement tending to inhibit corrosion thereof.

2. The method according to claim 1 including providing an inner anode of a sacrificial material for generating a galvanic current to the steel reinforcement, the inner anode being arranged so as to be positioned between the inside surface of the covering layer and said at least one outer surface of the concrete structure.

3. The method according to claim 2 wherein the covering layer, prior to application to said at least part of at least one outer surface of the structure for covering thereof, carries both the inner anode and the bulk anode and attaching the covering layer to the concrete structure so as to attach both the inner anode and the bulk anode carried thereby to the concrete structure.

4. The method according to claim 1 wherein the covering layer comprises a plurality of separate panels and the method includes connecting the plurality of separate panels to form an assembly which engages at least two surfaces of the concrete structure.

5. The method according to claim 4 wherein the plurality of separate panels includes a plurality of flat panels and a plurality of corner panels for connecting together to engage a plurality of surfaces of the concrete structure.

6. The method according to claim 4 including providing an inner anode of a sacrificial material for generating a galvanic current to the steel reinforcement, the inner anode being arranged so as to be positioned between the inside surface of the covering layer and said at least one outer surface of the concrete structure wherein at least one panel of said plurality of separate panels carries at least a part of the inner anode on an inner surface and at least one panel of said plurality of separate panels carries the bulk anode on an outer surface.

7. The method according to claim 4 including providing an inner anode of a sacrificial material for generating a galvanic current to the steel reinforcement, the inner anode being arranged so as to be positioned between the inside surface of the covering layer and said at least one outer surface of the concrete structure wherein at least one panel of said plurality of separate panels carries both at least a part of the inner anode on an inner surface and the bulk anode on an outer surface.

8. The method according to claim 1 wherein the concrete structure comprises a column and the covering layer when attached forms a jacket surrounding the column.

9. The method according to claim 1 wherein the concrete structure comprises a column and the covering layer comprises a plurality of separate components each surrounding a part of the column which when attached together form a jacket surrounding the column and wherein at least one of the components comprises at least a part of the bulk anode as a pre-assembled structure.

10. The method according to claim 1 wherein the covering layer comprises at least one covering component together with the bulk anode as a pre-assembled structure.

11. The method according to claim 10 wherein the pre-assembled structure comprises an electrical connection from the bulk anode for connection to the steel reinforcement in the concrete structure.

12. The method according to claim 11 wherein the pre-assembled structure comprises an electrical junction box including connection terminals for connection to the electrical connection from the bulk anode.

13. The method according to claim 12 wherein the electrical junction box is carried on the covering layer and is pre-connected to said electrical connection from the bulk anode.

14. The method according to claim 13 wherein the electrical junction box is mounted inside the covering layer and is accessible from outside the covering layer.

15. The method according to claim 1 wherein the bulk anode is mounted on an exterior of the covering layer with a connection plate on an interior.

16. The method according to claim 1 wherein the covering layer defines a form spaced from the surface for receiving grout which is cast between the covering layer and the surface.

17. The method according to claim 16 wherein there is provided a support member extending from the bulk anode attached to the covering layer into the grout to support the bulk anode when the grout hardens after casting.

18. The method according to claim 1 wherein the bulk anode is supported relative to the concrete surface by the connection of the bulk anode to the covering layer.

19. The method according to claim 1 wherein the bulk anode comprises aluminum.

20. The method according to claim 1 wherein the inner anode comprises zinc.

21. The method according to claim 1 wherein the ionically conductive medium is salt water.

* * * * *